US005109547A

United States Patent [19]

Abdallah

[11] Patent Number: 5,109,547

[45] Date of Patent: May 5, 1992

[54] EXTENDED NECKWEAR SHIRT ATTACHMENT DEVICE

[76] Inventor: Iman 'al-Amin Abdallah, 1186 Broadway #711, New York, N.Y. 10001

[21] Appl. No.: 480,842

[22] Filed: Feb. 16, 1990

[51] Int. Cl.[5] ..... A41D 25/04

[52] U.S. Cl. ..... 2/145; 2/144; 24/49 R; 24/49 CF; 24/49 TS; 24/49 S; 24/56; 24/57

[58] Field of Search ..... 2/137, 144, 145, 146, 2/152 R, 153; 24/49 R, 49 CF, 49 M, 49 K, 49 TS, 49 C, 49 S, 49 CD, 54, 56, 57, 50, 58, 60, 304, 306

[56] References Cited

U.S. PATENT DOCUMENTS

| | | | |
|---|---|---|---|
| 1,628,700 | 5/1927 | Waters | 2/146 |
| 1,751,963 | 3/1930 | Weinschreider | 2/145 |
| 1,960,145 | 5/1934 | Edelheit | 2/145 |
| 2,006,427 | 7/1935 | Wolfson | 2/145 |
| 2,389,784 | 11/1945 | Kennedy | 24/49 TS |
| 2,588,576 | 3/1952 | Roop et al. | 2/145 |
| 2,652,569 | 9/1953 | Confino | 2/145 |
| 2,656,543 | 10/1953 | Cohan | 2/146 |
| 2,762,099 | 9/1956 | Reed | 24/49 C |
| 3,097,362 | 7/1963 | Dinn | 2/145 X |
| 3,374,508 | 3/1968 | Slimovitz | 24/49 CP |
| 3,405,408 | 2/1969 | Baker | 2/145 |
| 3,453,696 | 7/1969 | Mates | 24/49 |
| 3,467,993 | 9/1969 | Smith | 24/50 |
| 3,487,471 | 1/1970 | Hagen | 2/145 |
| 3,735,422 | 5/1973 | Shemtov | 2/146 |
| 3,744,057 | 7/1973 | Luceri | 2/146 |
| 4,610,037 | 9/1986 | Haymer | 2/145 |
| 4,694,509 | 9/1987 | Grubman | 2/146 X |
| 4,827,576 | 5/1989 | Prince, Jr. | 2/145 X |
| 4,835,821 | 6/1989 | Durante | 2/144 X |
| 4,920,579 | 5/1990 | Swain | 2/145 |

FOREIGN PATENT DOCUMENTS

| | | | |
|---|---|---|---|
| 158526 | 8/1954 | Austria | 2/145 |
| 822985 | 10/1951 | Fed. Rep. of Germany | 2/145 |
| 1023486 | 3/1953 | France | 2/145 |
| 1177649 | 4/1959 | France | 2/145 |
| 437174 | 11/1967 | Switzerland | 24/56 |
| 22216 | of 1893 | United Kingdom | 24/56 |

*Primary Examiner*—Werner H. Schroeder
*Assistant Examiner*—Jeanette E. Chapman
*Attorney, Agent, or Firm*—Abdallah & Muckelroy

[57] ABSTRACT

An extended neckwear shirt button attachment device providing means to hold said neckwear in a stationary position at the front of a shirt or blouse, said attachment device comprising a base member and a button attachment member slidably attached to the base member. The button attachment member includes a buttonhole formed therein which selectively engages a button of the shirt or blouse of the wearer. The base member can be fixedly attached to the neckwear by adhesive means of by being sewn to the neckwear.

30 Claims, 4 Drawing Sheets

EXTENDED NECKWEAR SHIRT ATTACHMENT DEVICE

BACKGROUND OF THE INVENTION

The present invention generally relates to extended neckwear. More specifically, this invention relates to means for holding extended neckwear, for example, a four-in-hand type necktie, in alignment with the buttons at the front of a shirt or blouse having front-buttoned closure means.

Extended neckwear is a basic component of business and non-casual dress. Millions are worn each day. A recurring problem for the wearers of extended neckwear is control of the neckwear when worn. Neckties blow in the wind, are stained by falling into the wearer's food or into the washbowl when the wearer washes his/her hands, and shift about the wearer's neck resulting in a rumpled and disheveled appearance. A well-groomed wearer constantly fidgets with the necktie to keep it laying straight along the front of the shirt or blouse which results in additional staining of the necktie from particles embedded on the fingertips. Furthermore, a loose necktie often crawls outwardly from a tucked position within a coat or jacket necessitating constant handling of the necktie or stuffing of the necktie into the pants or skirt of the wearer.

These problems associated with extended neckwear have long been recognized and a variety of neckwear attachments such as necktie clips and necktie pins have been disclosed in the prior art to provide means for holding neckwear in a stationary position. A particular problem with many of these types of neckwear attachments is the material fatigue caused by their gripping or invasive means of engaging the neckwear and the body of the wearer's shirt or blouse. Another problem with many of the necktie clips and pins known in the prior art is that their utility is limited by their ornamental design or color which may clash with certain neckwear colors and print patterns. Also, metallic coated necktie clips and pins of inferior quality often peel and stain the necktie with metallic particles. Furthermore, necktie clips and pins are often lost because they are not permanently attached to the neckwear. Conventional necktie clips and pins also restrict simple vertical movements of the necktie because of their non-adjustable holding means.

In addition to the necktie clips and pins which attach to the body of the wearer's shirt, tie holder means are disclosed in the prior art which attach to the button of the wearer's shirt. In U.S. Pat. No. 2,029,597 to Thomas a tie holder is disclosed comprising a holding member adapted to pass around the necktie which includes a fixedly attached tab having a buttonhole which engages a button of the wearer's shirt. The holding member of the Thomas tie holder can be seen when worn and thus many of the problems of conventional tie clasps and the tie pins persist. In U.S. Pat. No. 3,793,681 to Casstevens et al. a necktie holder is disclosed which is not visible when worn and which accommodates vertical movement of the necktie, said necktie holder including button anchoring means and an elongated clamp which engages the necktie folds of the forepart of the necktie. The Casstevens invention is not fixedly attached to the necktie and thus can be lost or misplaced and the use of this necktie holder requires that the clamp penetrate the necktie or be aligned with the displaced portion of the folds between stitches. During normal wear this necktie holder will cause wear on the necktie fold stitches and thereby destroy the integrity of the necktie. Furthermore, the imprint of the clamp may be visible when used with a necktie constructed of silk or other soft material.

Necktie holding means that are fixedly attached to the necktie are also disclosed in the prior art. In U.S. Pat. No. 1,434,797 to Shannon there is disclosed a necktie fastener comprising a substantially rectangular piece of fabric fixedly attached to the rear face of the forepart of the necktie having a buttonhole formed therein for engagement with a button of the shirt or blouse of the wearer In U.S. Pat. No. 2,813,273 to Schreter a four-in-hand necktie is disclosed having a loop member attached to the rear face of the forepart of the necktie for removable receipt of the rearpart of the necktie, said rearpart including a group of equally spaced buttonholes for engagement with a button of the shirt or blouse of the wearer. For the Shannon and Schreter inventions to be functional the buttonholes in each must align horizontally with a button of the wearer's shirt or blouse. It should be noted that each time a necktie is tied the forepart and rearpart do not always extend for the same length and thus a fixedly attached button engagement device will not always fall in alignment with a button of the wearer's shirt or blouse. Furthermore, the various body sizes of wearers do not lend themselves to a standard array of buttonholes. Thus for different wearers and oftentimes for the same wearer the buttonholes will not be aligned with a button of the shirt or blouse and thus cannot be engaged therewith. Both the Shannon and Schreter disclosures fail to provide means to address the problem of misalignment of the buttonhole of the device and the button of the wearer's shirt or blouse.

Various necktie holding means in the prior art have however disclosed means to engage necktie fastener means with a button of the shirt or blouse when the two are not perfectly aligned. In U.S. Pat. No. 875,246 to Davies a necktie is disclosed having a plurality of independent button retaining devices, for example elastic loops, fixedly attached in vertical alignment to the rear face of the forepart of the necktie for engagement with a button of the wearer's shirt or blouse. In U.S. Pat. No 1,291,090 to Nuzum a necktie is disclosed having a transversely extending cloth bar which is selectively attachable to the wearer's shirt or blouse by means of a strip of cloth fixedly attached to said cloth bar having means for attachment to the wearer's shirt or blouse. The strip of cloth is wound about the cloth bar to selectively align the attachment means with the button of the wearer's shirt or blouse. In U.S. Pat. No. 2,738,513 to Carty a necktie holder is disclosed wherein a detachably securable fastening unit engages a fabric strip fixedly attached to the necktie, said fastening unit having a button fixedly attached to an elastic cord, said cord engaging the button of the wearer's shirt or blouse and the button of the fastening unit engaging a buttonhole formed in the fabric strip.

Another approach in the prior art to resolving the problem of misaligned button and button fastener means is the utilization of a vertically extending slot for engagement of a button on the wearer's shirt or blouse. U.S. Pat. No. 3,474,503 to Less discloses an attaching device for a necktie which includes a slotted tie anchor body which attaches to the rear face of the forepart of the necktie and receives a button of the wearer's shirt or blouse within the slot of the anchor body. When the button is received within the slot of the anchor body, the necktie and attached anchor body are permitted to move up and down on the button during vertical movement of the necktie. In U.S. Pat. No. 4,827,536 to Sung a necktie is disclosed having a meshed slot formed in the rearpart of the necktie which engages a button of the wearer's shirt or blouse. The rearpart is held in close proximity to the forepart of the necktie by means of a transverse loop fixedly attached to the rear face of the forepart of the necktie. In a further embodiment of the Sung invention a vertically disposed loop is attached to the transverse loop to support a button holder in slideable engagement, said button holder being provided for engagement with a button of the wearer's shirt or blouse. The button holder is double-sided to permit selective engagement of a shirt or blouse button by inverting the vertically disposed loop about the transverse loop. While the button holder embodiment of the Sung invention eliminates problems of the mesh being pulled when the button and mesh aperture are not perfectly aligned, the button holder of this invention will not maintain the lower portion of the forepart of the necktie in close proximity to the front of the shirt or blouse and thus will not prevent staining problems associated with a necktie falling in food, a washbowl and the like. In U.S. Pat. No. 4,827,576 to Prince a necktie attachment is disclosed comprising a vertically-slotted base member formed from a resilient material having a greater relative stiffness than the material of a necktie which preferably attaches to a necktie label loop and engages a button of the wearer's shirt or blouse within the slot of the base member. Affixation of the attachment to a label loop is not a stable attachment means because many label loops are loosely sewn to the forepart of the necktie. Also, label loops are attached to a necktie at various vertical positions along the length of the forepart, sometimes even being vertically disposed instead of transversely disposed, and thus no standard positioning of the attachment can be attained by utilizing this device. Furthermore, many label loops are too narrow to permit secure attachment of the Prince device. It should also be noted that the cantilevered attachment of the Prince invention permits the necktie to be displaced from the wearer's body for some distance which may not prevent some necktie staining as heretofore mentioned. In addition, the cantilevered attachment will only lay close to the wearer's body if he/she has a flat stomach and unfortunately many necktie wearers do not possess such a physique. A further difficulty with the slotted necktie holders of the prior art is their use of slotted members formed from relatively stiff material. While these necktie holders are attachable to the necktie in such a manner that they will not be visible from the front of the necktie, the wearer will be cognizant of their presence because of the stiff material utilized, adding to his/her psychological discomfort with these garment fastener means.

A combination sash tie and sash tie holder is disclosed in U.S. Pat. No. 4,190,904 to Nelson which is fixedly attached to a wearer's shirt or blouse by means of commercially available hook and loop tape. No means to adjust the point of attachment is disclosed in the Nelson invention.

Thus there remains a need for an aftermarket means to retain a necktie in a stationary position in vertical alignment with the front buttons of a wearer's shirt or blouse which is vertically adjustable, can be worn unseen, lays in smooth and close conformity with the body of the wearer, has a stable attachment means, can be universally attached to new and existing neckties, and prevents the material fatigue associated with conventional necktie clips and pins.

SUMMARY OF THE INVENTION

The present invention discloses an extended neckwear shirt attachment device generally comprising an elongated base member that is fixedly attachable to the rear face of the forepart of the neckwear, and a button attachment member that is slidably attached to the base member. The button attachment member includes a buttonhole which selectively engages a button of the shirt or blouse of the wearer. The base member is formed from a moderately flexible material, preferably a cloth-covered material, that conforms with the lay of the neckwear when worn and the button attachment member is preferably formed from cloth material.

A primary object of the present invention is to provide a neckwear shirt attachment device that maintains extended neckwear in close proximity to the wearer's body when the wearer bends over forwardly.

Another object of the present invention is to provide a neckwear shirt attachment device that facilitates the maintenance of a well-groomed appearance during various twisting and turning movements of the upper body of the wearer.

A further object of the neckwear shirt attachment device of the present invention is to provide means to prevent neckwear from being pulled into industrial equipment or interfering with machine repair operations and the like.

It is also an object of the neckwear shirt attachment device of the present invention to provide means to hold extended neckwear in vertical alignment with the buttons of a shirt or blouse of the wearer.

Another object of this invention is to provide a neckwear shirt attachment device which is fixedly attachable to the rear face of the forepart of extended neckwear having means for receipt of the rearpart of the extended neckwear.

A still further object of this invention is to provide a neckwear shirt attachment device having button attachment means which can be vertically adjusted to facilitate selective engagement of the button attachment means with the buttons of the shirt or blouse of the wearer.

It is also an object of the present invention to provide a neckwear shirt attachment device having self-adjusting means to accommodate vertical movement of the neckwear when worn.

A still further object of the present invention is to provide a neckwear shirt attachment device of simple construction that lays in smooth and close conformity with the wearer's body.

Another object of the present invention is to provide a universal neckwear shirt attachment device that is readily adaptable to both newly purchased and existing extended neckwear.

It is also an object of the present invention to provide a necktie having integrally constructed means to selectively attach the necktie to a button of the shirt or blouse of the wearer.

These and other objects and advantages of the present invention will be apparent to those skilled in the art from the following drawings, description of preferred embodiments and appended claims.

PREFERRED EMBODIMENTS OF THE INVENTION

Figure 1:
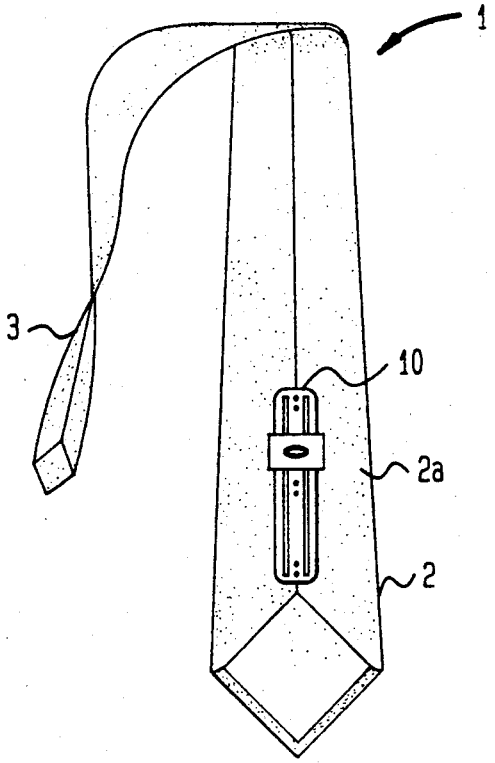
FIG. 1 is a perspective view of a four-in-hand type necktie having a first preferred embodiment of the neckwear shirt attachment device of the present invention attached to the rear face of the forepart of the necktie.

FIG. 1 illustrates in a perspective view a first preferred embodiment of the neckwear shirt attachment device 10 of the present invention shown attached to a four-in-hand type necktie 1. The attachment device 10 is fixedly attachable to the rear face 2*a* of the wide forepart 2 of the necktie 1 and thus can be worn unseen from the front when the necktie 1 is tied about the wearer's neck.

Figure 2:
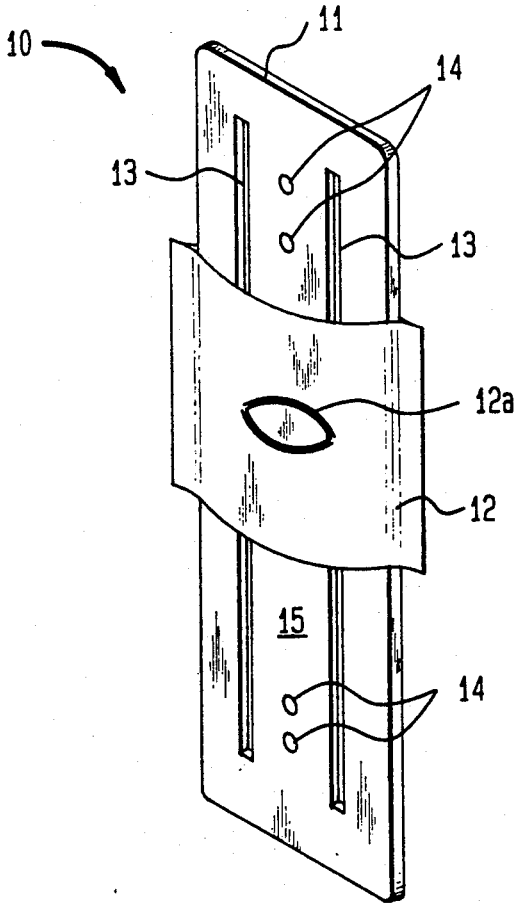
FIG. 2 is an enlarged front perspective view of the first preferred embodiment of the neckwear shirt attachment device.
Figure 4:
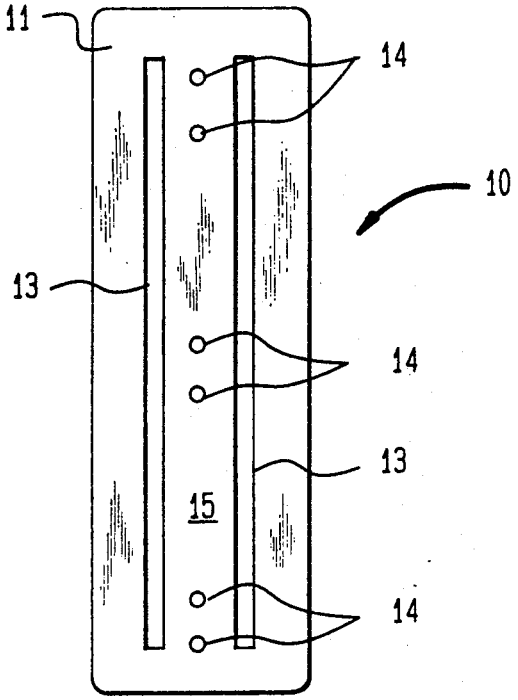
FIG. 4 is a front plan view of the base member of the first preferred embodiment of the present invention.

FIG. 2 illustrates an enlarged front perspective view of the shirt attachment device 10. Attachment device 10 generally comprises an elongated, substantially rectangular base member 11 and a shirt button attachment member 12 slidably attached to said base member 11. The base member 11 includes a pair of vertically-extending slots 13 disposed in spaced relationship to each side of a plurality of stitching holes 14 formed along the vertical mid-line of the central rib 15 formed by said slots 13. It is preferred that six stitching holes 14 be formed in said base member 11 being disposed in three pairs located proximate the respective ends of the base member 11 and about the midpoint of said base member 11 (FIG. 4). Base member 11 is preferably formed as a $5\frac{3}{4}''$ by $1\frac{1}{4}''$ strip of cloth-covered plastic material of moderate stiffness, for example, the PERMAFUZED belt backing material manufactured by Supply Manufacturing Co., Inc. of Brooklyn, N.Y.

Figure 11:
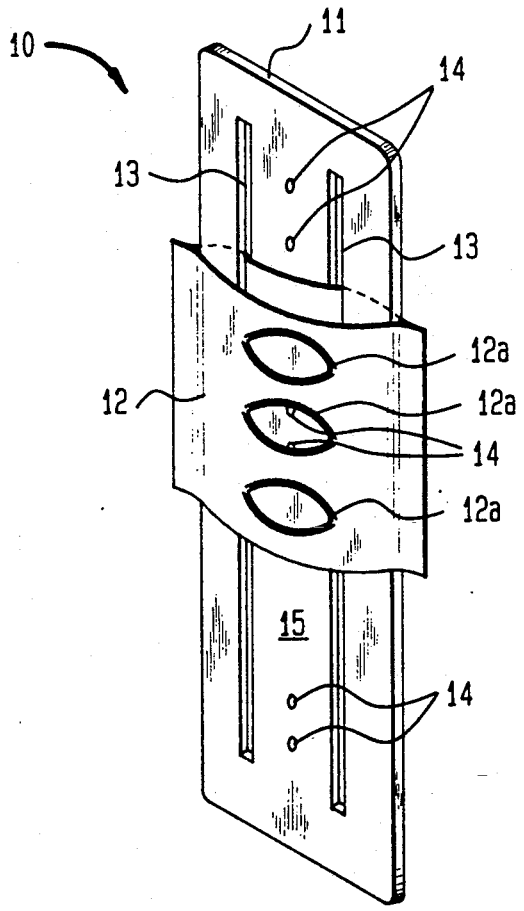
FIG. 11 is a front perspective view of an alternate construction of the first preferred embodiment of the neckwear shirt attachment device.

Shirt button attachment member 12 substantially comprises a continuous rectangular loop of cloth material slidably engaging the slots 13 of said base member 11. A buttonhole 12*a* is formed at the midpoint of said button attachment member 12. As can be best seen by viewing FIGS. 2 and 3 in conjunction, button attachment member 12 extends about the sides of said base member 11 and across the forward face of the central rib 15 passing through the respective slots 13. Thereby the button attachment member 12 can be selectively adjusted vertically relative to said base member 11 to facilitate engagement of the buttonhole 12*a* of said attachment member 12 with a button of the shirt or blouse of the wearer as hereinafter described in greater detail. Button attachment member 12 also provides means for receipt of the narrow rearpart 3 (FIG. 1) of the necktie 1 when said necktie 1 is tied about the wearer's neck. Buttonhole 12*a* is shown in the first preferred embodiment to extend horizontally but may alternatively be formed to extend vertically. Furthermore, said button attachment member 12 may be formed with a plurality of vertically aligned buttonholes 12*a* (FIG. 11). The button attachment member 12 may be formed of the same material from which the necktie 1 is constructed or material that coordinates with the cloth cover of said base member 11.

Figure 3:
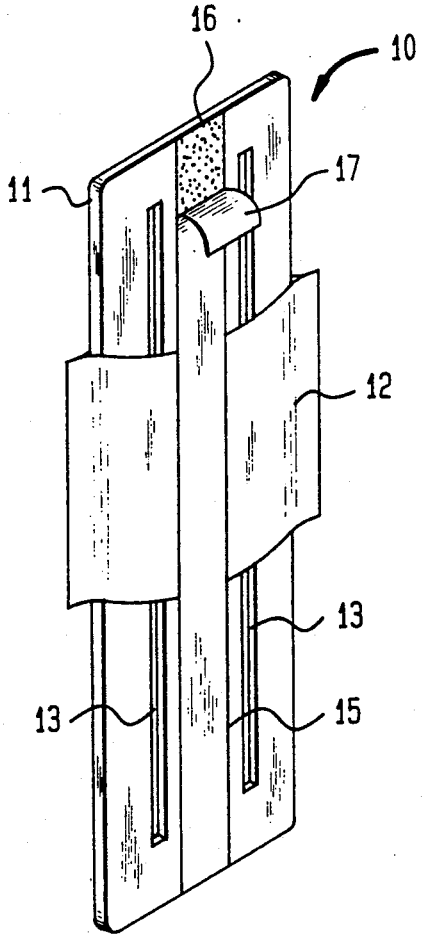
FIG. 3 is an enlarged rear perspective view of the first preferred embodiment of the neckwear shirt attachment device.

Referring now to the rear perspective view of the first preferred embodiment of the attachment device 10 shown in FIG. 3 it can be seen that base member 11 includes means to fixedly attach the base member 11 to the necktie 1, preferably comprising a strip of two-sided cloth adhesive 16 disposed along the rearward face of the central rib 15 of said base member 11. The cloth adhesive 16 is covered by a removable adhesive liner 17 to facilitate storage of the attachment device 10 prior to attachment to the necktie 1.

Figure 5:
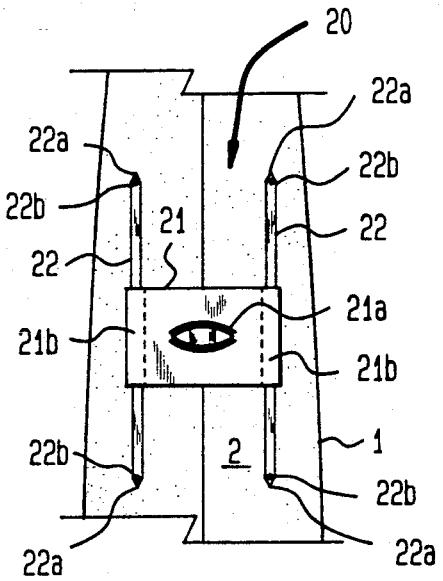
FIG. 5 is a front plan view of a second preferred embodiment of the present invention shown attached to the rear face of the forepart of a four-in-hand type necktie.

FIG. 5 illustrates a front plan view of a second preferred embodiment of the neckwear button attachment device 20. The second preferred embodiment of the device 20 comprises a second button attachment member 21 which slidably engages a pair of support strips 22 fixedly attachable to the rear face of the wide forepart 2 of the necktie 1. The second button attachment member 21 generally comprises a rectangular piece of cloth that includes a centrally disposed buttonhole 21*a* and looped side edges 21*b*, said looped side edges 21*b* being provided to receive the respective support strips 22 in slidable engagement. The support strips 22 are formed having beveled ends 22*a* and a stitching hole 22*b* disposed proximate to the respective ends 22*a* of said support strips 22. Said stitching holes 22*b* provide means to threadedly attach said strips 22 to the rear face of the forepart 2 of said neckwear 1. Each strip 22 is preferably formed from a heat resistant plastic material of moderate stiffness, for example, the material used for shirt collar stays, to prevent destruction of the strips 22 when the neckwear 1 is dry-cleaned or washed. When attached the mid-portion of each support strip 22 is freely displaced from the neckwear 1 to which it is attached thereby permitting the piece of cloth 21 to be selectively adjusted vertically to facilitate alignment of the buttonhole 21*a* with a button of the shirt or blouse of the wearer. The mid-portion of each support strip 22 may be stiffened or formed with a thicker cross-section to limit the deflection of said strip 22.

Figure 6:
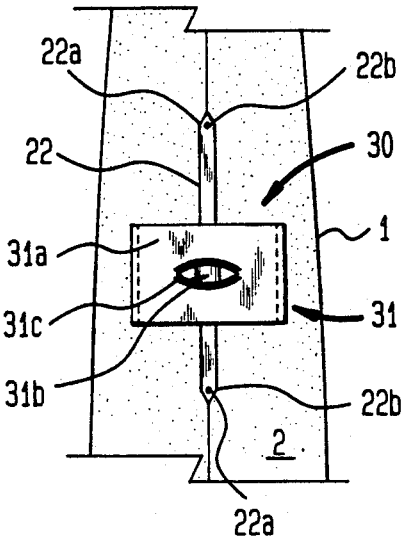
FIG. 6 is a front plan view of a third preferred embodiment of the present invention shown attached to the rear face of the forepart of a four-in-hand type necktie.
Figure 7:
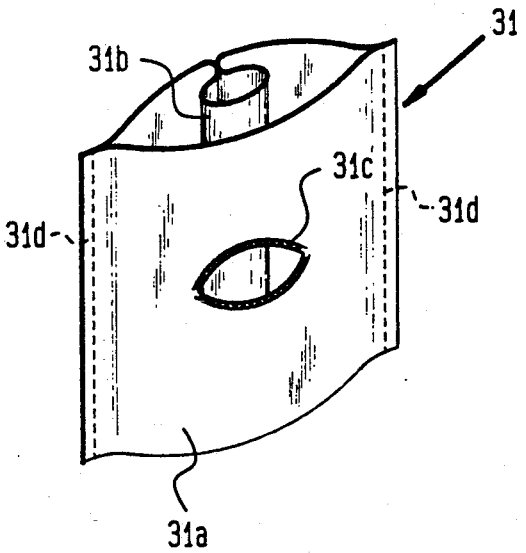
FIG. 7 is an enlarged perspective view of the button attachment means of the third preferred embodiment of the present invention.

FIG. 6 illustrates in a front plan view a third preferred embodiment of the attachment device 30. The third embodiment 30 generally comprises a third button attachment member 31 slidably engaging a single support strip 22. The support strip 22 in the third embodiment is formed as heretofore described for the second preferred embodiment of the attachment device 20 shown in FIG. 5. As can be best seen in the perspective view of the third button attachment member 31 shown in FIG. 7, said third button attachment member 31 comprises continuous loop of cloth material 31*a* having a closed secondary loop 31*b* formed therein by making a vertical stitch to gather opposing portions of the continuous loop of cloth material 31*a*. A buttonhole 31*c* is formed in the continuous loop 31*a* opposite said secondary loop 31*b*. Said support strip 22 slidably engages the secondary loop 31*b* to provide means for slidable adjustment of the third button attachment member 31 to facilitate alignment of the buttonhole 31*c* with a button of the shirt or blouse of the wearer. Threaded stitching 31*d* is provided along the vertical side edges of said loop of cloth material 31*a* thereby engaging marginally displaced to facilitate limiting of the displacement of the loop of cloth material 31*a* from the neckwear 1 when attached to a shirt.

Figure 8:
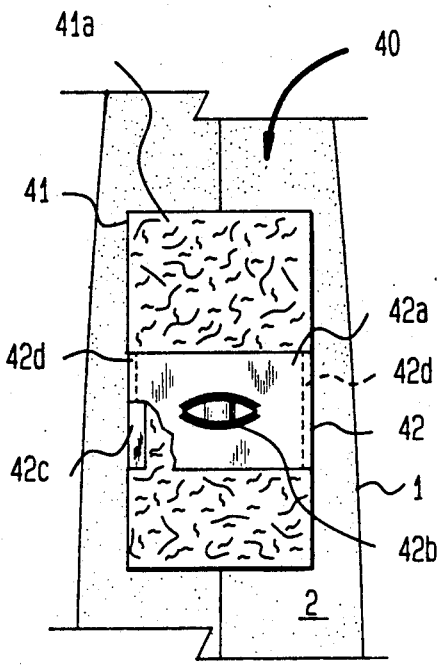
FIG. 8 is a front plan view of a fourth preferred embodiment of the present invention shown attached to the rear face of the forepart of a four-in-hand type necktie.
Figure 9:
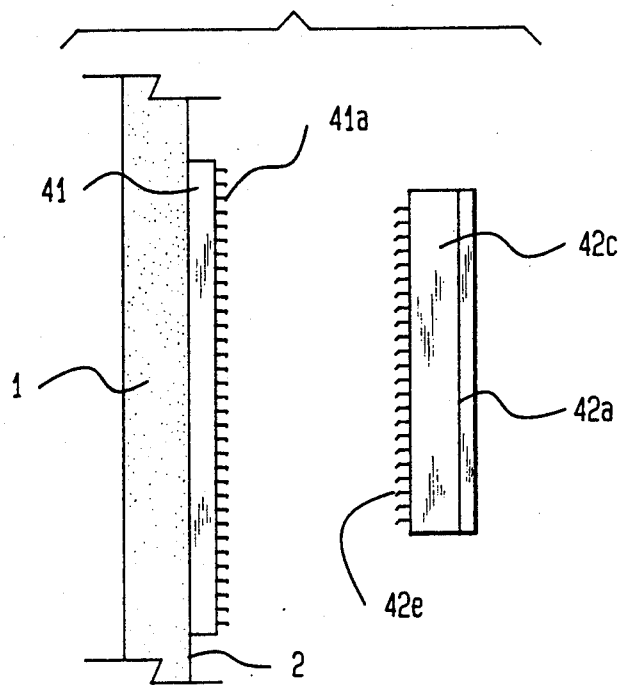
FIG. 9 is a side plan view of the fourth preferred embodiment of the present invention.

FIGS. 8 and 9 illustrate a fourth preferred embodiment of the attachment device 40. The fourth embodiment 40 is a two-component device that includes a base component 41 and a button attachment component 42, said base component 41 and said button attachment component 42 being attachable to each other by means of hook and loop tape fastener, for example, Velcro tape. In the fourth preferred embodiment 40 the base component 41 is formed from the loop portion of Velcro tape and is fixedly attached to the rear face of the forepart 2 of the neckwear 1, either by sewing or by use sticky back Velcro tape, with the loop surface 41*a* outwardly disposed. The button attachment component 42 substantially comprises a rectangular piece of cloth 42*a* having a centrally disposed buttonhole 42*b* and component engagement strips 42*c* fixedly attached at the respective vertical side edges 42*d* of said piece of cloth 42*a*. The engagement strips 42*c* are formed from the hook portion of the Velcro tape and are attached to the piece of cloth 42*a* with the hook surface 42*e* of said button attachment component 42 with the loop surface 41*a* of said base component 41 the button attachment component 42 can be adjusted vertically to facilitate alignment of said buttonhole 42*b* with a button of the shirt or blouse of the wearer. Alternatively, in lieu of strips 42*c* a single rectangular engagement patch (not shown) formed from the hook portion of Velcro tape may be attached to the piece of cloth 42*a*, said patch extending the width of said piece of cloth 42*a* and being sewn at the vertically-extending edges of said piece of cloth 42*a*.

The various embodiments of the neckwear shirt button attachment device of the present invention are substantially attached to the necktie 1 and operated in the same manner. Upon being fixedly attached to the rear face of the wide forepart 2 of the necktie 1, the necktie 1 is tied as generally known. The narrow rearpart 3 of the necktie 1 is then placed through the button attachment member of the device. The attachment member is then vertically adjusted to align the buttonhole of the device with a button of the shirt or blouse of the wearer and the button is engaged with the buttonhole.

The heretofore descriptions of preferred embodiments of the present invention disclose aftermarket attachment devices for neckties. The teachings of the present disclosure can also be utilized for the construction of a necktie that includes integrally constructed slidably adjustable means for attaching extended neckwear to a button of the shirt or blouse of the wearer.

Figure 10:
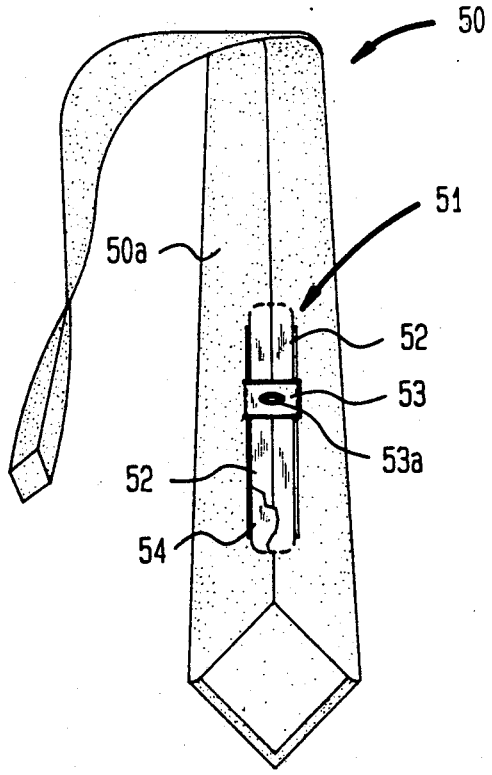
FIG. 10 is a perspective view of a four-in-hand type necktie having integrally constructed shirt button attachment means in accordance with the teachings of the present invention.

FIG. 10 illustrates in a partially fragmented perspective view the rear portions of a four-in-hand type necktie 50 having integrally constructed means 51 to attach the necktie 50 to a button of the shirt or blouse of the wearer. The necktie 50 is generally formed as known in the prior art for extended neckwear having shirt button attachment means 51 disposed in the lower portion of the wide forepart of the necktie 50. Vertical slots 52 are cut into the rear face 50*a* of the necktie 50 and slidably engage a button attachment member 53 comprising a continuous loop of cloth material having a buttonhole 53*a* formed therein as previously described. A stiffener 54, preferably formed from moderately stiff plastic material, is fixedly attached to the underside of the rear face 50*a* of the necktie 50 between said vertical slots 52.

Various changes, modifications, additions and deletions may be made to the invention of the present disclosure as heretofore described without departing from the spirit and scope of this invention, and such changes, modifications, additions and deletions are intended to be included in the present invention as described in the appended claims. For example, the second, third and fourth embodiments of the present invention may include reinforcement to stiffen the button attachment member against deflection. Furthermore, the button attachment means may include magnetic attachment means for attachment of the device to metal buttons or snap closure means.

Therefore, in view of the foregoing I claim:

1. A device for attaching tied extended neckwear to a button of a shirt of a wearer, said extended neckwear including a wide forepart and a narrow rearpart, said device comprising an elongated base member;

button attachment means attached in slidable and threaded engagement to said base member to form a unitary structure permitting slidable movement of said button attachment means along substantially the entire length of said base member; and means to fixedly attach the unitary structure comprising said base member and the attached button attachment means to the wide forepart of the extended neckwear having the length of said base member extending vertically, said device being selectively attachable to a button of the shirt of the wearer by engagement of said button attachment means with said button.

2. A device as described in claim 1 wherein said elongated base member is formed having a plurality of stitching holes thereby providing means for said base member to be fixedly attached to the extended neckwear by sewing thread through said stitching holes.

3. A device as described in claim 2 wherein said base member includes adhesive means for fixedly attaching said base member to said extended neckwear thereby providing alternative means for said base member to be fixedly attached to the extended neckwear.

4. A device as described in claim 1 wherein said means to fixedly attach said base member to the extended neckwear comprises a strip of adhesive tape disposed on one side of said base member.

5. A device for attaching tied extended neckwear to a button of a shirt of the wearer comprising an elongated, substantially rectangular base member having a pair of vertically-extending slots formed therein in spaced relationship thereby forming a central rib;

a shirt button attachment member comprising a continuous loop of cloth material slidably engaging the slots of said base member, said loop of cloth material extending about the sides of said base member and across the forward face of the central rib passing through the respective slots of said base member, said loop of cloth material having a buttonhole formed therein; and means to fixedly attach said base member to the extended neckwear comprising a strip of two-sided cloth adhesive disposed along the rearward face of the central rib of said base member, said device being selectively attachable to a button of the shirt or blouse of the wearer by engagement of said button attachment means with said button.

6. A device as described in claim 5 wherein said base member includes a plurality of stitching holes.

7. A device as described in claim 6 wherein there are six stitching holes in said base member disposed in three pairs respectively located proximate to a first end of the base member, a second end of the base member and about the midpoint of said base member.

8. A device as described in claim 5 wherein said base member is formed as a 5¾" by 1¼" strip of cloth-covered plastic material of moderate stiffness.

9. A device as described in claim 5 wherein said loop of cloth material of said button attachment member is formed with a plurality of vertically aligned buttonholes.

10. A device as described in claim 5 wherein said loop of cloth material is formed from the same material from which the neckwear is constructed.

11. A device as described in claim 5 said loop of cloth material is formed from the same material of the cloth cover of said base member.

12. A device as described in claim 5 wherein said cloth adhesive is covered by a removable adhesive liner.

13. A device for attaching tied extended neckwear to a button of a shirt of the wearer comprising a pair of support strips fixedly attachable in spaced relationship to said extended neckwear; p1 a button attachment member comprising a length of material having closed loops formed at respective ends thereof and a buttonhole formed therein between said closed loops, the loops of said button attachment member being slidably engaged with said pair of support strips; and means to fixedly attach ends of said support strips to said extended neckwear.

14. A device as described in claim 13 wherein said button attachment member comprises a rectangular piece of cloth having a centrally disposed buttonhole and looped side edges, said support strips being receivable within said looped side edges in slidable engagement.

15. A device as described in claim 13 wherein said support strips are formed having beveled ends and a stitching hole disposed proximate to the respective ends of said support strips.

16. A device as described in claim 15 wherein said support strips are formed from a heat resistant plastic material of moderate stiffness.

17. A device as described in claim 16 wherein the mid-portion of each support strip is reinforced for stiffness to limit the deflection of said support strip.

18. A device as described in claim 16 wherein the mid-portion of each support strip is formed with a thicker cross-section to limit the deflection of said strip.

19. A device for attaching tied extended neckwear to a button of a shirt of the wearer comprising a single support strip fixedly attachable to said extended neckwear;

a button attachment member comprising a continuous loop of cloth material having a buttonhole formed therein and a secondary loop disposed opposite to said buttonhole, the secondary loop of said button attachment member being slidably engaged with said support strip; and means to fixedly attach ends of said support strip to said extended neckwear.

20. A device as described in claim 19 wherein the secondary loop of said button attachment member is formed by making a vertical stitch to gather opposing displaced portions of the continuous loop of cloth material, said support strip being receivable within the secondary loop in slidable engagement.

21. A two-component device for attaching tied extended neckwear to a button of a shirt of the wearer comprising a base component fixedly attachable to said neckwear formed from the loop portion of hook and loop tape, the looped surface thereof being outwardly disposed from said neckwear, and a button attachment component comprising a rectangular piece of cloth having engagement strips disposed at respective vertical side edges of said piece of cloth and a buttonhole formed therein between said engagement strips, said engagement strips being formed from the hook portion of hook and loop tape, the hooked surface thereof being disposed to engage the looped surface of said base component, said base component and said button attachment component being selectively attachable to each other by engagement of the hooked surface of said button attachment component and the looped surface of said base component.

22. A device for attaching extended neckwear of the type having a narrow end and a wide end to a button of a shirt of a wearer comprising an elongated rectangular base member;

means to fixedly attach the respective ends of the base member to the wide end of said extended neckwear having the sides of the base member vertically disposed; and a closed loop of material having a buttonhole formed therein, said loop of material being slidably disposed about the sides of said base member to permit said loop of material to be selectively moved vertically along said base member, said device being selectively attachable to a button of the shirt of the wearer by engagement of said buttonhole with said button.

23. An improvement in four-in-hand type extended neckwear having a wide end and a narrow end, said improvement providing means to selectively attach said neckwear to a button of a shirt of a wearer, said improvement comprising an elongated rectangular base member;

means to fixedly attach the respective ends of the base member to the wide end of said extended neckwear having the sides of the base member vertically disposed; and a closed loop of material having a buttonhole formed therein said loop of material being slidably disposed about the sides of said base member to permit said loop of material to be selectively moved vertically along said base member, said loop of material being selectively attachable to a button of the shirt of the wearer by engagement of said buttonhole with said button.

24. A device for attaching tied extended neckwear to a button of a shirt of the wearer comprising a base member fixedly attachable at opposing ends thereof to said neckwear, said base member being covered by cloth material, and a loop of material slidably disposed about said base member between said opposing ends of said base member, said loop of material having a buttonhole formed therein, said loop of material being selectively attachable to a button of the shirt of the wearer by engagement of said buttonhole with said button.

25. A device as described in claim 24 wherein said base member is formed from belt backing material.

26. A device as described in claim 24 wherein said base member includes base member stiffening means.

27. A device as described in claim 24 wherein said loop of material includes material stiffening means.

28. An improvement in a four-in-hand type necktie of the type having a wide forepart, a narrow rearpart, a front face and a rear face, said improvement comprising an elongated base member fixedly attached at opposing ends thereof to the rear face of the wide forepart of said necktie, and a loop of material slidably disposed about the sides of said base member between the opposing ends of said base member, said loop of material having a buttonhole formed therein, said loop of material being selectively attachable to a button of the shirt of the wearer by engagement of said buttonhole with said button.

29. An improvement in a four-in-hand type necktie as described in claim 28 wherein said base member is formed from belt backing material.

30. An improvement in a four-in-hand type necktie as described in claim 29 wherein said base member is covered with cloth material.

* * * * *